US006790087B2

(12) United States Patent
Ho

(10) Patent No.: US 6,790,087 B2
(45) Date of Patent: Sep. 14, 2004

(54) ELECTRICAL CONNECTOR HAVING A WIRE GUIDE

(75) Inventor: Yi-Tse Ho, Tainan Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/318,498

(22) Filed: Dec. 13, 2002

(65) Prior Publication Data

US 2003/0129875 A1 Jul. 10, 2003

(30) Foreign Application Priority Data

Dec. 19, 2001 (TW) ..... 90222333 U

(51) Int. Cl.[7] ..... H01R 13/58
(52) U.S. Cl. ..... 439/606; 439/942; 439/579
(58) Field of Search ..... 439/579, 606, 439/701, 942, 719, 874

(56) References Cited

U.S. PATENT DOCUMENTS 4,252,397 A * 2/1981 Eigenbrode et al. ..... 439/405
4,704,091 A * 11/1987 Owens et al. ..... 439/281
4,973,264 A * 11/1990 Kamono et al. ..... 439/498
5,595,497 A * 1/1997 Wood ..... 439/282
6,129,594 A * 10/2000 Lai ..... 439/701
6,482,021 B2 * 11/2002 Hara et al. ..... 439/279

* cited by examiner

*Primary Examiner*—Tho D. Ta
(74) *Attorney, Agent, or Firm*—Robert J. Zeitler

(57) ABSTRACT

The present utility model provides an electric connector that includes an insulative housing, a plurality of conductive terminals and a base. The electric connector can be electrically connected to a cable, or plugged into another complementary electric connector. The insulative housing has an insertion side, a connecting side and a plurality of terminal receiving tunnels connected to the insertion side and the connecting side. Each of the conductive terminals is received in a corresponding terminal receiving tunnel and has a connecting section extending outside the connecting side. The base has a plurality of grooves for receiving respective connecting sections of the conductive terminals and a stop block to substantially seal the terminal receiving tunnels so that the conductive terminals can be positioned easily when soldered to a cable wire. An overmolding process is applied to manufacture a protective sleeve to envelop the insulative housing assembled with a plurality of conductive terminals and a base. This prevents positional deviation of the terminals and seepage of the injected molding material into the terminal tunnels.

8 Claims, 5 Drawing Sheets

PRIOR ART

PRIOR ART

ELECTRICAL CONNECTOR HAVING A WIRE GUIDE

FIELD OF THE INVENTION

The invention relates to an electric connector, more particularly to an electric connector which can be easily positioned and soldered to a cable and which are reliable for production.

BACKGROUND OF THE INVENTION

FIGS. 1, 2 and 3 illustrate an electric connector 3 to be used with a cable 4, and to mate with a complementary electric connector (not shown here). The electric connector includes an insulative housing 31, a plurality of conductive terminals 32 and a protective sleeve 33. The insulative housing 31 has a front end having a insertion side 3101 for connection with a complementary electric connector, and a rear end having a connecting side 3102. The insulative housing 31 is further formed with a plurality of terminal receiving tunnels 311 connected to the insertion side 3101 and the connecting side 3102. The terminal receiving tunnels 311 respectively have openings 3110 on the connecting side 3102. Each conductive terminal 32 has an insertion end 321, a connecting end 322 and a positioning section 323 connected to the insertion end 321 and the connecting end 322. Two opposite sides of the positioning section 323 are formed with barbs. Referring to FIG. 2, a conductive terminal 32 is placed in a corresponding terminal receiving tunnel 311 though an opening 3110 on the connecting side 3102. Via interferential engagement of the positioning section 323 with the inner wall of the corresponding terminal receiving tunnel, the insertion end 321 of the conductive terminal 32 is positioned in the terminal receiving tunnel 311 near the insertion side 3101 so as to electrically contact a corresponding terminal of a complementary electric conductor. At the same time the connective end 322 of the terminal extends outside the connecting side 3102 so as to be soldered to the cable 4. Lastly, as shown in FIG. 3, a protective sleeve is injection molded via an overmolding method so as to entirely envelop the connecting side 3102 of the insulative housing 31 and the soldering joints of the connecting ends 322 of all of the conductive terminals and the cable 4. Only the insertion side 3101 of the insulative housing 31 is exposed.

However, the following drawbacks are encountered in manufacturing the aforesaid electric connector:

1) It is difficult to solder the conductive terminals 32 to the cable 4. As shown in FIG. 2, after each conductive terminal 32 is positioned in each corresponding terminal receiving tunnel 311, each connecting end 322 thereof projects outside the connecting side 3102 in a suspended manner. Therefore the operation to solder the connecting ends 322 and the cable 4 is performed in a situation in which the connecting ends 322 and the cable 4 are not supported. If any one thereof is displaced, the quality of the soldering connection will be adversely affected, and difficulty will increase in the soldering operation.

2) It is difficult to position conductive terminals during manufacturing a protective sleeve 33. When an overmolding process is used to manufacture a protective sleeve 33, a flowable plastic material must be first injected into the mold so as to form the protective sleeve 33. However, high pressure generated upon injection of the molding material will keep the material to flow continuously. And since the solder connection between the connecting ends 322 and the cable 4 is in an unsupported state, upon being subjected to impact due to the high-pressure injected material, the connecting ends 322 of conductive terminals 32 will displace and contact adjacent connecting ends 322. In severe occasions, the terminals can even break, resulting in inferior products. To prevent the foregoing drawback, during the manufacturing of the protective sleeve 33, an adhesive tape or silicone adhesive filler is used to position the soldering junction between the connecting ends 322 and the cable 4 before the plastic material is injected into the mold. However, this extra positioning procedure will increase manufacturing cost and decrease the efficiency of production.

3) The plastic material injected during manufacturing of the protective sleeves 33 tends to seep into the terminal receiving tunnel 311. Due to the fact that there are openings 3110 of the terminal receiving tunnels 311 formed in the connecting side 3102 of the insulative housing 31, the high pressure plastic material for forming the protective sleeves 33 will overflow and seep into the terminal receiving tunnel 311. If the quantity of the overflowing material is too much, then the insertion ends 321 of the conductive terminals 321 will be covered by the plastic material or displaced from the original position, which in either case would produce unstable mating connection between the electric connector and an associated complimentary electric connector, and can even impair the electrically connecting effect.

4) The protective sleeves tend to deform after contraction due to cooling. As described in the foregoing, each connecting end 322 of the conductive terminal 32 is unsupportedly hung outside the connecting side 3102. Therefore, after the plastic material is injected into the mold and cooled down to form the protective sleeve 33, the lowering of temperature tends to contract the plastic material around the soldering junction between the connecting ends 322 and the cable 4, thus forming depression thereabout. Though this phenomenon does not alter the performance of the connector 3, it could affect the appearance thereof, rendering the product unacceptable. This increases the manufacturing cost.

SUMMARY OF THE INVENTION

Therefore, the main object of the present invention is to provide an electric connector that is easy to be positioned when being soldered to a cable and that can prevent the positional change or damage caused by the material injected during the manufacturing of the protective sleeves.

Another object of the present invention is to provide an electric connector that can prevent the plastic material injected during manufacturing the protective sleeves from seeping into the electric connector.

Accordingly, an electric connector of this invention comprises an insulative housing having an insertion side for insertion into a complementary electric connector, a connecting side and a plurality of terminal receiving tunnels connected to the insertion side and the connecting side;

a plurality of conductive terminals, each of the conductive terminal having a insertion end and a connecting end, each of the conductive terminal being placed in a corresponding one of the terminal receiving tunnels, the connecting end extends outside the connecting side;

a base having a plurality of grooves, the base further including one side which is adjacent to the connecting side of the housing and which has a stop block, the base having holes extending through the stop block at locations corresponding to the grooves, wherein, after the base is connected to the housing, the holes permit the connecting ends to pass therethrough and to be received in the grooves, and the stop block substantially covers the openings of the tunnels in the connecting side of the insulative housing.

The electrical connector may also include a protective sleeve covering the insulative housing, but exposing the insertion side of the insulative housing.

The electrical connector may also include an interference portion on said housing. The interference portion may assist in retaining the protective sleeve to the insulative housing.

The electrical connector may also include other features as more fully described in the specification.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENTS

Figure 1:
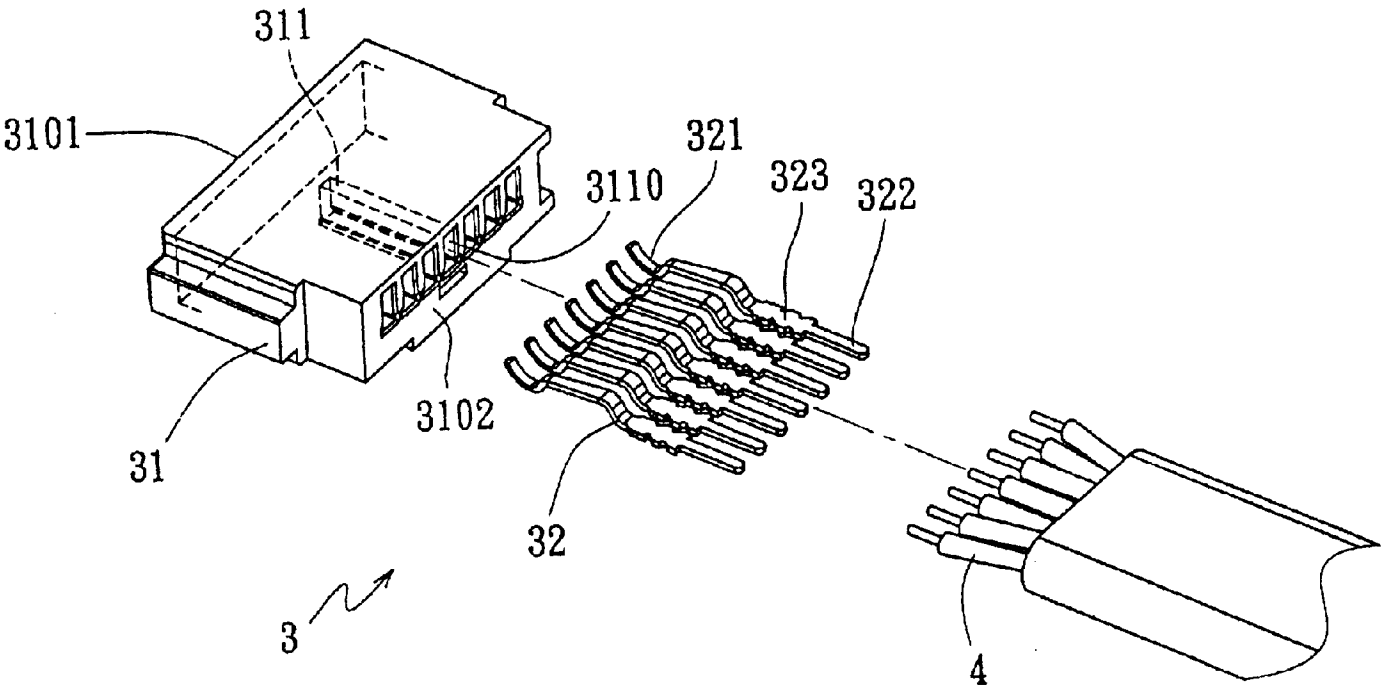
FIG. 1 is an exploded perspective view of part of the structure of a conventional electric connector to illustrate the relation among an insulative housing, a plurality of conductive terminals and a cable.
Figure 2:
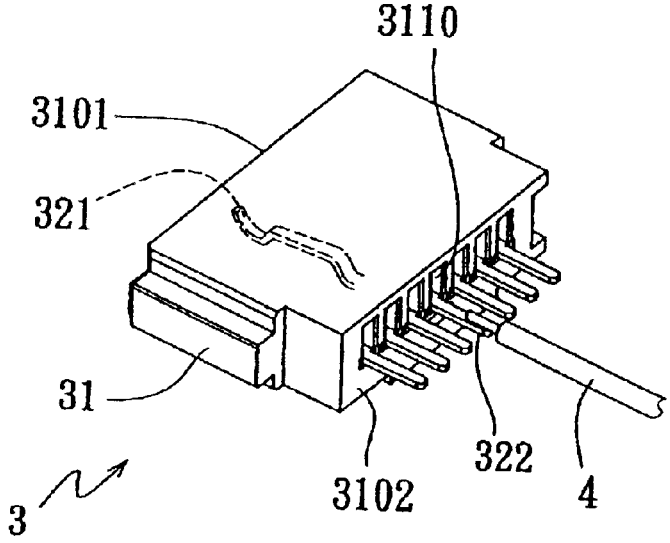
FIG. 2 is a perspective view of the connector of FIG. 1 to illustrate the assembling relation among an insulative housing, a plurality of conductive terminals and a cable after assembly.
Figure 3:
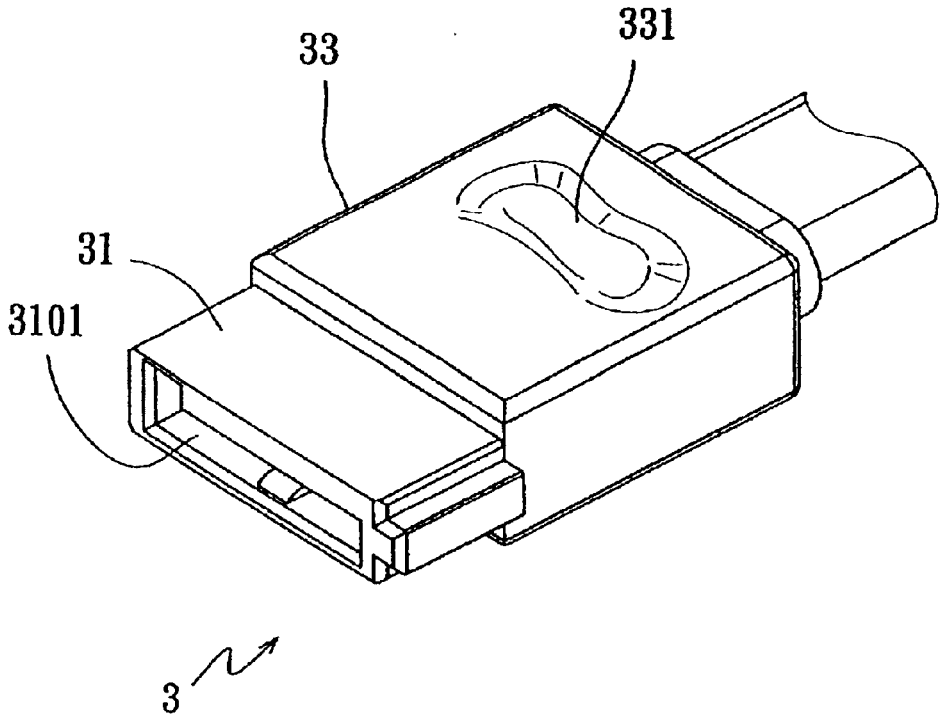
PRIOR ART FIG. 3
FIG. 3 is a perspective view of a protective sleeve enveloping the electric connector of FIG. 1.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 4:
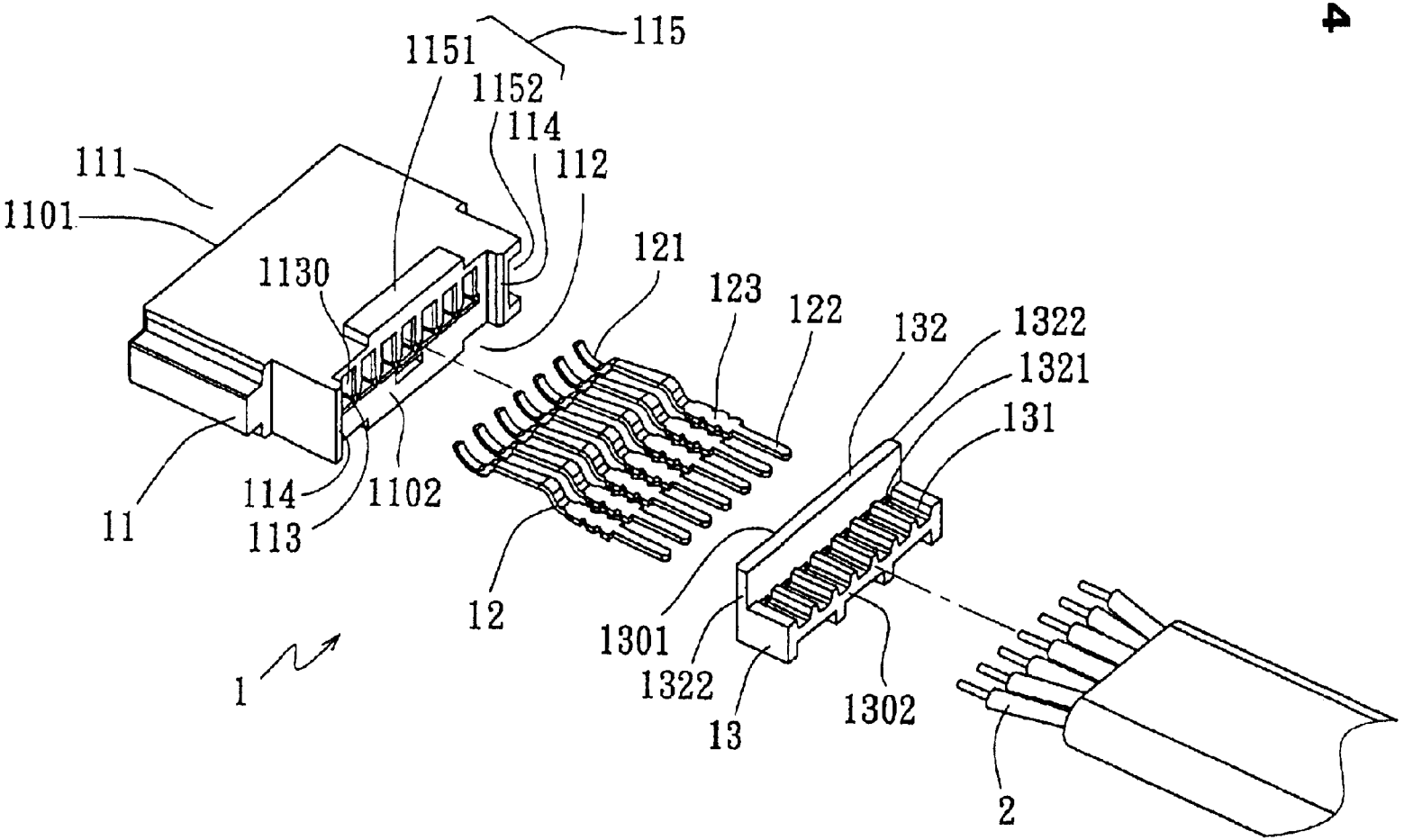
FIG. 4 is an exploded perspective view of part of the structure of a preferred embodiment of an electric connector according to the present invention to illustrate the relation among an insulative housing, a plurality of conductive terminals and a cable.
Figure 5:
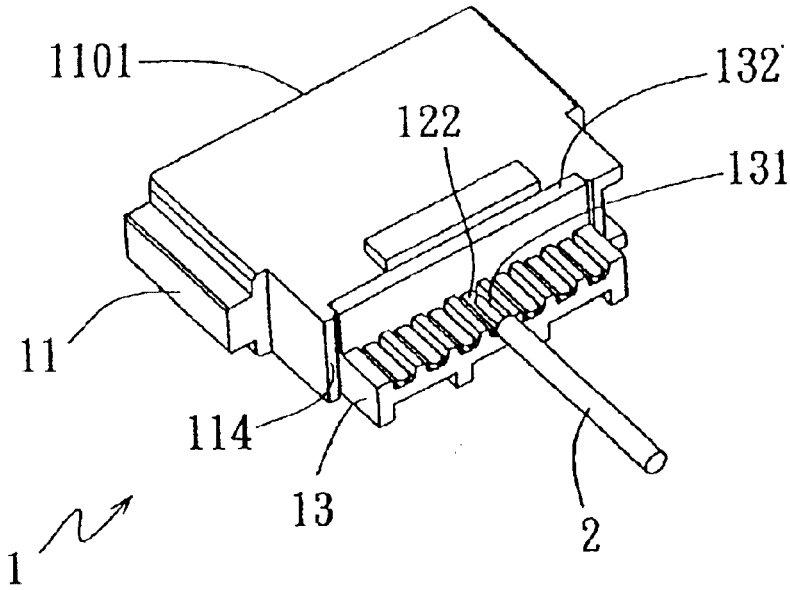
FIG. 5 is another assembled perspective view of the embodiment of FIG. 4 to illustrate the relation among an insulative housing, a plurality of conductive terminals and a cable after assembly.

Referring to FIGS. 4 and 5, a preferred embodiment of an electric connector 1 according to the present invention is shown to comprise an insulative housing 11, a plurality of conductive terminals 12 and a base 13. The electric connector 1 is solderable to a cable 2 and matable with a complementary electric connector (not shown here).

The insulative housing 11 includes a front side 111 and a rear side 112 opposite to the front side 111. The front side 111 is formed with a insertion side 1101 to mate with a complementary electric connector. The rear side 112 is formed with a connecting side 1102 parallel to the insertion side 1101. The insulative housing 11 is formed with a plurality of terminal receiving tunnels 113 connected to the insertion side 1101 and the connecting side 1102. Each of the terminal receiving tunnels 113 is formed with a corresponding opening 1130 on the connecting side 1102 respectively. Moreover, left and right lateral sides of the connecting side 1102 have protruding flanges 114 extending outwardly from the connecting side 1102.

Each of the conductive terminals 12 has a insertion end 121, an opposite connecting end 122 and a positioning section 123 between the insertion end 121 and the connecting end 122. Two opposite sides of the positioning section 123 are formed with barbs. Each conductive terminal 12 is placed in a corresponding terminal receiving tunnel 113 though an opening 1130 on the connecting side 1102, and is positioned by interferential engagement of the positioning section 123 with an inner wall of the corresponding terminal receiving tunnel 113 so that the insertion end 121 of the conductive terminal 12 is positioned inside the corresponding terminal receiving tunnel 113 near the insertion side 1101, and the connective end 122 extends outwardly of the connecting side 1102.

Figure 6:
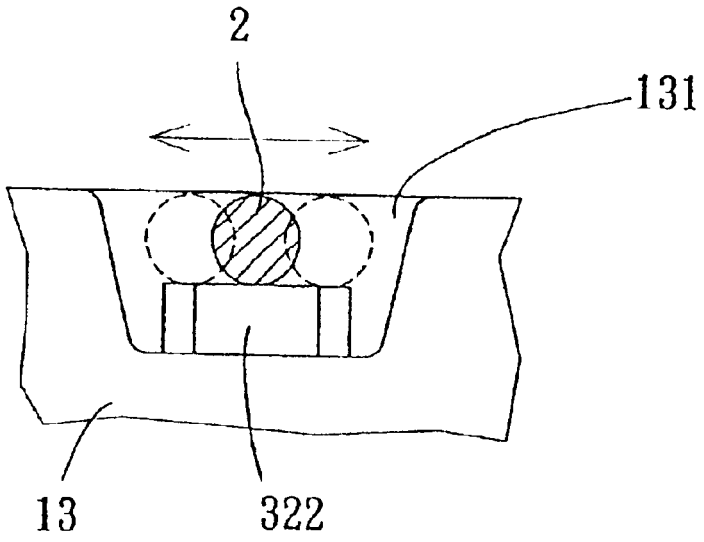
FIG. 6 is a schematic cross-sectional view of part of the structure of the preferred embodiment of a electric connector according to the present invention to illustrate the positional relation among a groove, a connecting end of a conductive terminal and a cable.

The base 13 has a first side 1301 that can abut against the connecting side 1102, and a second side 1302 opposite to the first side 1301. The top surface of the base 12 is formed with a plurality of grooves 131 extending from the first side 1301 to the second side 1302. The locations of the grooves 131 correspond to the connecting ends of the conductive terminals respectively. As shown in FIG. 6, the cross section of the groove 131 is in the shape of a downwardly tapering trapezoid. Moreover, the base 13 has a stop block 132 proximate to the first side 1301. The stop block 132 extends upwardly and transversely from the first side 1301. The stop block 132 is further formed with a plurality of through holes 1321 at the locations corresponding to those of the grooves 132 respectively. At two opposite lateral sides of the stop block 132 are formed connecting surfaces 1322. As shown in FIG. 5, the base 13 can interlock with the insulative housing 11 by tight engagement between the connecting surfaces 1322 at two sides of the stop block 132 and the protruding flanges 114 of the housing 11, thereby causing the first surface 1301 to abut against the connecting side 1102. The through holes 1321 only permit the connecting ends 122 of the respective conducting terminals 12 to pass through and to be received in the corresponding grooves 131. The stop block 132 substantially seals, or covers, the openings 1130 in the end of the terminal receiving tunnels 113 and formed on the connecting side 1102, and the connecting ends 122 of all the conducting terminals 12 in the grooves 121 are soldered to cable wires 2.

Referring again to FIGS. 5 and 6, by virtue of the foregoing structure, after the insulative housing 11, the conducting terminals 12 and the base 13 are assembled with each other, the connecting end 122 of each conducting terminal 12 is received and constrained within the corresponding groove 131 such that no left or right positional deviation will occur and such that adjacent conducting terminals 12 do not contact each other. When the terminals are soldered to the cable wires 2, corresponding cable wires will be respectively connected to the connecting ends 122 and constrained by the respective grooves 131. Therefore, even if left or right positional deviation occurs in aligning the cable wire 2, the deviation will not extend beyond the range of the grooves 131. Furthermore, during soldering, since the cable wire 2 and the connecting end 122 are simultaneously supported by the base 132, reliability of the solder connection is greatly improved and alignment for the solder connection is facilitated.

Figure 7:
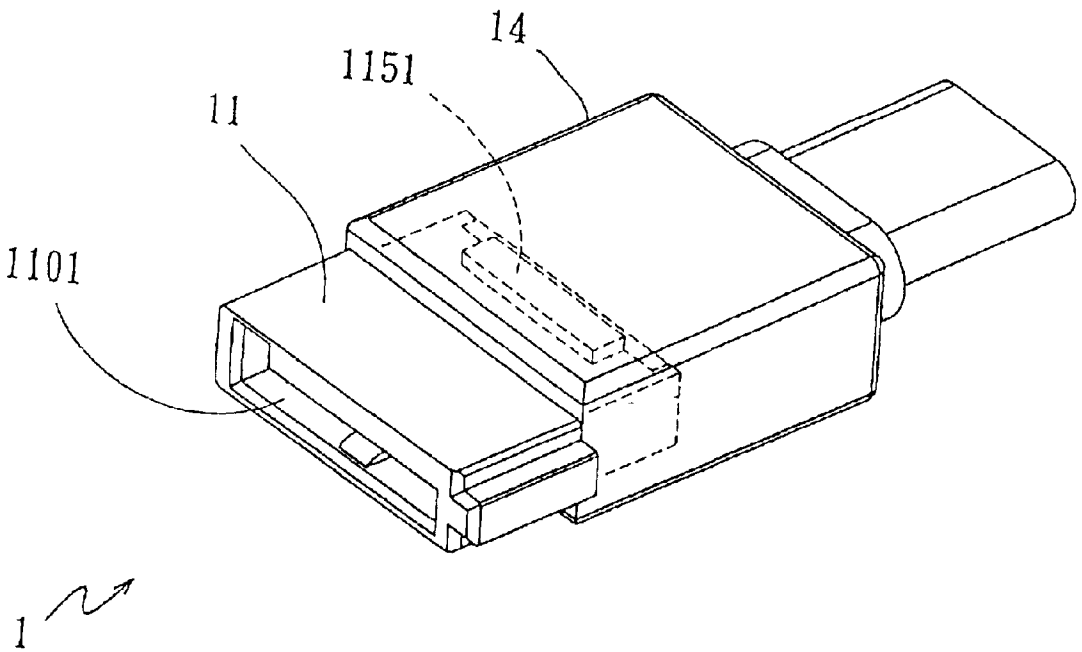
FIG. 7 is a perspective view of a protective sleeve enveloping the electric connector of FIG. 5.

Referring to FIG. 7, an additional protective sleeve is provided after the insulative housing 11, the conducting terminals 12 and the base 13 are assembled together. The protective sleeve 14 is formed by an injection molding method in which the injected material is molded over the insulative housing 11 assembled with the conducting terminals 12 and molded over the solder connection between the conducting terminals 12 and the cable wires 2. During overmolding, the insertion side 1101 of the insulative housing 11 is exposed so as to be able to mate with a complementary electric connector. Moreover, due to the constraining and supporting actions of the grooves 131 of the base 13 on the connecting ends 122 of the conducting terminals 12, even if the connecting ends 122 are subjected to the high pressure of the plastic material injected during the molding of the protective sleeves 14, the connecting end 122 of the conducting terminal 12 will not displaced, unlike the terminals in the prior art. And since the opening 1130 of each terminal receiving tunnel 113 is sealed by the stop block 132 of the base 13, the plastic material used in forming the protective sleeves 14 will not overflow and seep into the terminal receiving tunnel 113. Therefore, the problem of covering the insertion ends 121 of the conducting terminals 12 by the plastic material, or the problem of the positional change is avoided. As such, reliability for the production is highly improved. Aside from that, since the base 13 fills the gaps between the connecting ends 122 of the conducting terminal 12 beforehand, the protective sleeve 14 will not shrink considerably upon being cooled and hardened, thereby maintaining the existing appearance.

Referring again to FIGS. 4 and 7, to prevent the protective sleeve 14 from separating from the insulative housing 11 after cooling down the sleeve 14, an interference portion 115 is provided on the insulative housing 11 to interferentially engage with the protective sleeve 14. In this embodiment, the interference portion 115 may either include a protruding block 1151 protruding from the surface of the insulative housing 11 or a concave groove 1152 formed in the surface of the insulative housing 11. These configuration variations can provide interference engagement with the formed protective sleeve 14 so as to prevent the protective sleeve 14 from separating from the insulative housing 11 due to stresses.

While the present invention has been described in connection with what is considered the most practical and preferred embodiments, it is understood that this invention is not limited to the disclosed embodiments but, rather, that those skilled in the art may devise various modifications of the present invention without departing from the spirit and scope of the appended claims.

What is claimed is:

1. An electric connector comprising:

an insulative housing having an insertion side for insertion into a complementary electric connector, a connecting side and a plurality of terminal receiving tunnels connected to the insertion side and the connecting side;

a plurality of conductive terminals, each of the conductive terminal having an insertion end and a connecting end, each of the conductive terminal being placed in a corresponding one of the terminal receiving tunnels, the connecting end extends outside the connecting side;

a base having a plurality of grooves, the base further including one side which is adjacent to the connecting side of the housing and which has a stop block, the base having holes extending through the stop block at locations corresponding to the grooves, wherein, after the base is connected to the housing, the holes permit the connecting ends to pass therethrough and to be received in the grooves, and the stop block substantially covers the openings of the tunnels in the connecting side of the insulative housing; and a protective sleeve covering the insulative housing, but exposing the insertion side of the insulative housing, the protective sleeve being formed by overmolding.

2. The electric connector as claimed in claim 1, wherein the terminals include a positioning section located between the insertion end and the connecting end, the positioning section interferentially engaging the terminal receiving tunnel.

3. The electric connector as claimed in claim 1, wherein the connection between the base and the housing is an interference connection.

4. The electric connector as claimed in claim 1, wherein a conductor of a cable is received in the groove for electrical connection to the connecting end of the terminal.

5. The electric connector as claimed in claim 1, wherein the interference portion assists in retaining the protective sleeve to the housing.

6. The electric connector as claimed in claim 1, wherein the insulative housing further includes an interference portion.

7. The electric connector as claimed in claim 6, wherein the interference portion includes a protruding block that protrudes from the insulative housing.

8. The electric connector as claimed in claim 6, wherein the interference portion includes a concave groove that is formed in the surface of the insulative housing.

* * * * *